United States Patent [19]

Schwarze

[11] Patent Number: 4,821,549

[45] Date of Patent: Apr. 18, 1989

[54] TUBE BENDING MACHINE

[76] Inventor: Rigobert Schwarze, Olpener Str. 460-474, 5000 Köln 91, Fed. Rep. of Germany

[21] Appl. No.: 143,617

[22] Filed: Jan. 13, 1988

Related U.S. Application Data

[63] Continuation of Ser. No. 862,309, May 8, 1986, abandoned.

[30] Foreign Application Priority Data

May 10, 1985 [DE] Fed. Rep. of Germany ..... 3516923

[51] Int. Cl.[4] ..... B21D 7/04

[52] U.S. Cl. ..... 72/157; 72/159

[58] Field of Search ..... 72/157, 159, 156, 149, 72/321, 320, 442, 453.01

[56] References Cited

U.S. PATENT DOCUMENTS

| | | | |
|---|---|---|---|
| 3,147,792 | 9/1964 | Hautau | 72/157 |
| 3,299,681 | 1/1967 | Hautau | 72/157 |
| 4,038,853 | 8/1977 | Schwarze | 72/157 |
| 4,238,398 | 12/1980 | Schwarze | 72/157 |
| 4,416,136 | 11/1983 | Schwarze | 72/157 |
| 4,495,788 | 1/1985 | Traub | 72/157 |

FOREIGN PATENT DOCUMENTS

| | | | |
|---|---|---|---|
| 25279 | 1/1956 | Fed. Rep. of Germany | 72/157 |
| 1087431 | 8/1960 | Fed. Rep. of Germany | 72/149 |
| 2626202 | 12/1977 | Fed. Rep. of Germany . | |
| 120336 | 10/1984 | Fed. Rep. of Germany . | |
| 178131 | 10/1984 | Japan | 72/157 |

*Primary Examiner*—Daniel C. Crane

*Attorney, Agent, or Firm*—Michael J. Striker

[57] ABSTRACT

In a tube bending machine including a bending template having a groove receiving a tube portion to be bent and a clamping jaw cooperating with the bending template to bend the tube portion, the template and the clamping jaw each includes a clamping element with interchangeable clamping faces. Each clamping element has a hydraulic drive incorporated in the template and the clamping jaw, respectively.

6 Claims, 2 Drawing Sheets

TUBE BENDING MACHINE

This is a continuation of application Ser. No. 862,309, filed May 8, 1986, now abandoned.

BACKGROUND OF THE INVENTION

The present invention relates to a tube bending machine of the type including a bending templete provided with a groove receiving a portion of the tube being bent, and a clamping device holding the tube wrapped about the template.

Upon bending tubes in which some curved portions are adjacent to the next curved portion, without the provision of straight intermediate portions therebetween, and also upon bending tubes which have at their head ends the shape different from that of the remaining length of the tube, for example tubes having an enlargement or a welded flange before the curved portion, the exchange of the clamping surfaces on the bending template and also on the claiming jaw is necessary. Many various designs have been proposed to obtain an interchange of clamping surfaces.

German Pat. No. 26 26 202 of the applicant has disclosed the clamping jaw pivotable about a horizontal axis whereby the clamping faces of different embodiments have been arranged on the periphery of the clamping jaw and have been brought into action as desired.

European patent application No. 012,0336 filed by the applicant has disclosed supporting surfaces on the bending template and the clamping jaw, respectively, and particularly a recess for interchangeably-receiving of clamping elements having clamping faces, and wherein each clamping element is mounted on a guide and provided with a hydraulic drive which imparts to the clamping element in the recess the vertical movement so that out of a plurality of different clamping faces arranged one under the other only one or the other clamping face appears in the plane of the groove of the bending template.

SUMMARY OF THE INVENTION

It is an object of the present invention to provide an improved tube bending machine.

It is a further object of this invention to arrange the clamping elements on the bending template and the clamping jaw in such a manner and move the clamping elements so that a quick exchange of the clamping faces on the clamping elements would be possible and the clamping faces would not damage the tubes upon the insertion thereof in the bending machine and during the bending process.

These and other objects of the invention are attained by a tube bending machine comprising a bending table pivotable about a first axis and including a bending template, a clamping jaw displaceable relative to the bending template, and a displaceable feeding carriage having a rotatable clamping sleeve whereby the bending template and the clamping jaw have, respectively, clamping faces corresponding to each other and adjusted to straight and bend portions of a tube being bent, said clamping faces being spaced from each other and bringable into an operation position such that a recess for an interchangeably-receiving a respective clamping element provided with the clamping faces is formed, respectively in the bending template and the clamping jaw, each clamping element being mounted on a guide and provided with a hydraulic drive which vertically moves the clamping element received in a respective recess so that out of a plurality of various clamping faces positioned one under the other only one or the other clamping face is brought in a plane of a groove of the bending template, a respective hydraulic cylinder of the hydraulic drive of the respective clamping element being arranged immediately in at least the bending template and the clamping jaw.

The clamping jaw may be rotatable about a horizontal axis and have two limiting flat surfaces positioned at right angles to each other in at least one of said flat surfaces, the clamping element provided with a plurality of different clamping faces being displaceably supported. Thus relatively narrow space of the clamping faces can be used for various clamping faces.

The clamping element mounted on said bending template may have three different clamping faces and the clamping element mounted on said clamping jaw may have two different clamping faces.

Due to the present invention a cylindrical chamber for the drive of the clamping element of the bending tempalte is arranged in the interior of the bending template whereas the cylindrical chamber receiving the piston of the drive of the clamping element of the clamping jaw is provided within the clamping jaw. Thus each hydraulic drive projects from the upper surface of the respective chamber only by a small distance and, upon the insertion of the tube between the clamping jaw and bending template, and also bending the tube no significant obstacles to bending result. This is obtained due to the provision of the horizontal arm or boom connected to the respective piston rod of the respective drive.

Inasmuch as the bending template is comparatively flat a part of the cylinder can extend upwardly beyond the upper side of the template. It is possible that a portion of the cylinder project downwardly over the underside of the template. At any rate the construction height of the bending template and/or clamping jaw is used for incorporating or at least partially incorporating the hydraulic drive.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
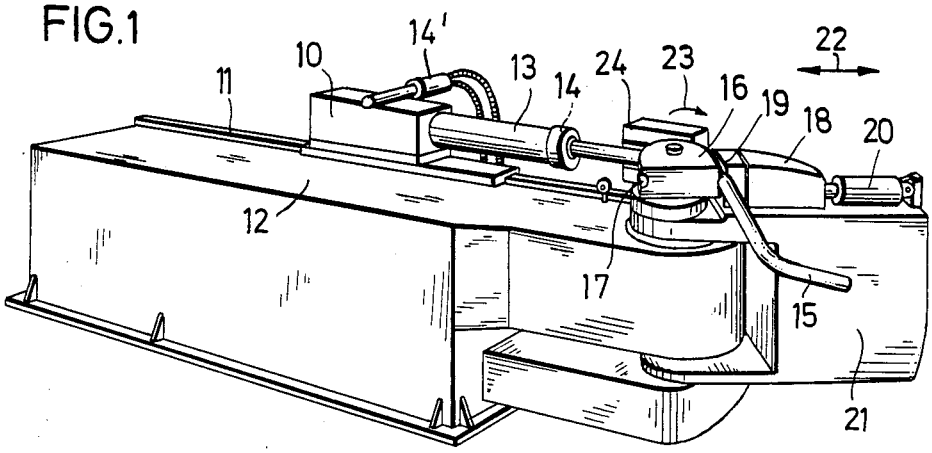
FIG. 1 is a perspective view of a tube-bending machine of the invention.

Referring now to the drawings in detail, FIG. 1 illustrates a customary tube bending machine including a feeding carriage 10 which slides back and forth on one or a number of guiding rails 11 provided on the upper side of the machine housing 12.

The feeding carriage 10 has a hollow cylinder 13, in the interior of which a clamping sleeve 14 is positioned. The end portion of the tube piece being bent is clamped in the clamping sleeve 14. The tubular piece 15 is guided about a pivotally supported bending template 16 which has a groove 17 corresponding in size to a half diameter of the tube being bent so that the tube is received in said groove. At one portion of the tube piece 15 wrapped about the bending template, is pressed a clamping jaw 19 by means of a clamping device 18; clamping jaw 19 has eventually a groove corresponding to the half diameter of the tube and acting as a clamping surface so that tube 15 is clamped against the bending template 16.

A hydraulic cylinder 20, which can be replaced by any other suitable arrangement, moves the clamping device 18 of the clamping jaw 19 towards the bending template for clamping the tube, and away from the template. The bending template 16 is rigidly mounted to a bending table 21 while the clamping device 18 is displaceable back and forth by cylinder 20 in the directions of arrows 22. If the bending template 16 is pivoted together with the clamping jaw 19 in the direction of arrow 23 the tubular piece is bent so that a bend is produced thereon, which corresponds to the profile of the bending template 16. During the bending process the end portion of the tubular piece 15 remains in the clamping sleeve 14 of the feeding carriage 10 which reliably guides the tubular piece in all positions. Thereby the free tubular piece 15 positioned between the clamping sleeve 14 and the bending template 16 can not be pushed laterally, and the sliding rail 24, which also has a groove corresponding to a half diameter of the tube is pressed against this tubular piece. The clamping sleeve 14 of the feeding carriage 10 not only rigidly clamps the tubular piece 15 but is also adapted to turn up to about 360° when the tube bent portions following one another must be bent in different directions. For rotating the clamping sleeve 14 serves a hydraulic motor which rotates a worm which in turn cooperates with a worm gear cooperating with the clamping sleeve 14.

Figure 2:
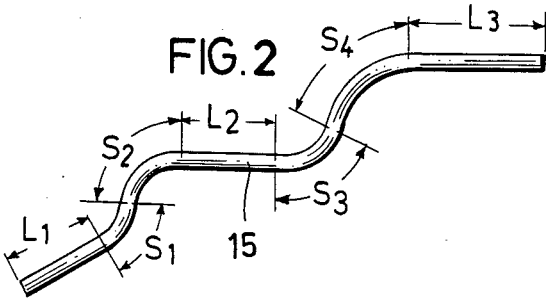
FIG. 2 is a tube bent on the machine.

FIG. 2 illustrates an exhaust or muffler pipe which is produced by the bending machine of the invention. The pipe shown in FIG. 2 has bend portions S1, S2, S3 and S4 and straightline intermediate portions L1, L2, L3.

In the tube illustrated in FIG. 2 straight line intermediate portions are provided between some of the bend portions and not provided between other bend portions. FIG. 2 shows the tube which can be bent by a single clamping on the tube bending machine. Such a machine in FIG. 3.

Figure 3:
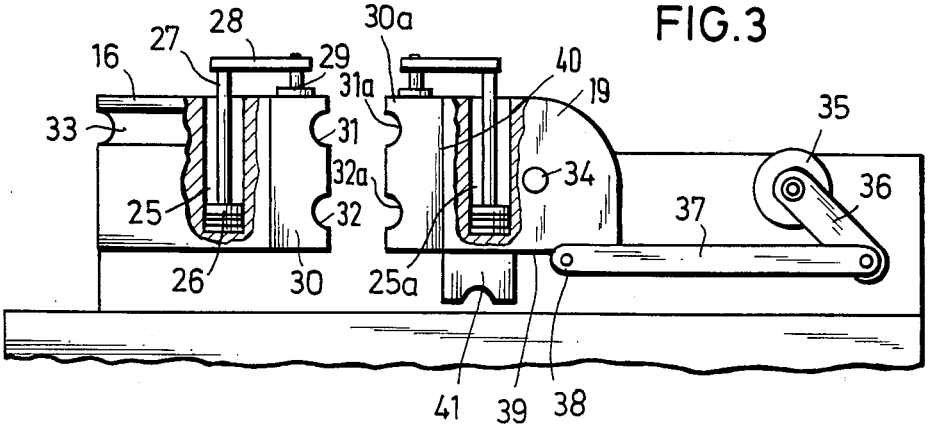
FIG. 3 is a partial vertical section of the bending table with a bending template and clamping jaws.
Figure 4:
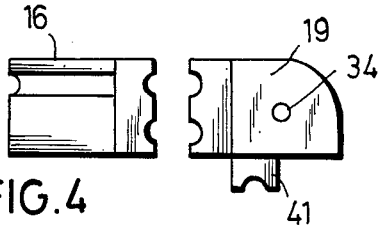
FIGS. 4 through 7 schematically show clamping surfaces arranged differently relative to each other.
Figure 5:
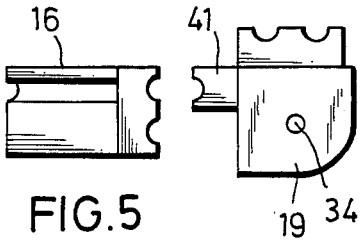
Figure 6:
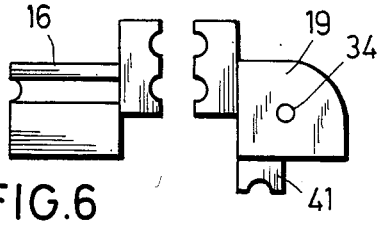
Figure 7:
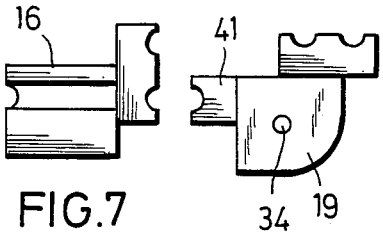

With reference to FIG. 3 it will be seen that inside the bending template, a cylinder 25 of a hydraulic drive is provided, which has a piston 26 with a piston rod 27 movable in chamber 25. At the upper end of the piston rod, is provided a boom or arm 28 extended at right angles to the piston rod 27. A clamping element 30 is arranged on the boom 28 by means of a connecting element 29. The clamping element 30 has two clamping faces 31 and 32 which are vertically offset relative to each other. The bending template has a bending groove 33.

The opposite clamping jaw 19 also has a cylinder or chamber **25*a* with the piston and piston rod reciprocating therein. The clamping element or body 30*a* is provided with clamping faces 31*a* and 32*a*** vertically spaced from each other.

The clamping jaw 19 is additionally pivotable about a horizontal axis 34 and is provided in accordance with FIG. 3 with an arm 36 driven by a hydraulic motor 35. A rod 37 is pivoted on the arm 36. Rod 37 is connected to an axle 38 of the clamping jaw 19. The latter has flat surfaces 39 and 40 extended at right angles to each other, whereby the clamping element **30*a* with the spaced clamping faces 31*a* and 32*a* is displaceably supported on the surface 40 whereas the stationary clamping element 41 is arranged on the flat surface 39**.

FIGS. 4 to 8 illustrate various positions of the clamping elements 30 relative to the opposing clamping elements **30*a* or in dependence upon the rotation of the clamping jaw relative to the opposite individual clamping element 41**.

Various operative positions of the clamping elements are obtained by actuation of the respective hydraulic drives via the reciprocal movements of the piston rods and rotation of the clamping jaw about the axis 34.

Figure 8:
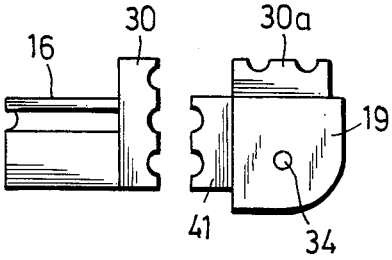
FIG. 8 is a modified embodiment of the clamping element.

FIG. 8 shows that the clamping element 30 is positioned on the bending template 16. Clamping element 30 has clamping faces of different dimensions. The clamping faces are arranged one under the other. Clamping elements **30*a* and 41*a* are provided on the clamping jaw 19. Clamping elements 30*a* and 41*a*** are displaceable on the respective surfaces by the hydraulic drive and have two different clamping faces.

It is to be noted that analogously to FIG. 8 not only two peripheral surfaces limiting each other can provide the flat structure with the clamping elements but also three or more surfaces limiting each other can be provided.

It will be understood that each of the elements described above, or two or more together, may also find a useful application in other types of tube bending machines differing from the types described above.

While the invention has been illustrated and described as embodied in a tube bending machine, it is not intended to be mitied to the details shown, since various modifications and structural changes may be made without departing in any way from the spirit of the present invention.

Without further analysis, the foregoing will so full reveal the gist of the present invention that others can, by applying current knowledge, readily adapt it for vairous applications without omitting features that, from the standpoint of prior art, fairly constitute essential characteristics of the generic or specific aspects of this invention.

What is claimed as new and desired to be protected by Letters Patent is set forth in the appended claims:

1. In a tube bending machine comprising a bending table pivotable about a first vertical axis and including a bending template, a clamping jaw displaceable relative to the bending template for clamping a tube between the clamping jaw and bending template to bend said tube about said bending template, and a displaceable feeding carriage having a rotatable clamping sleeve for clamping a tube being bent and for feeding and rotating said tube through said clamping jaw and bending template, whereby the bending template and the clamping jaw have, respectively, clamping elements each having at least two clamping faces which have different shapes, are positioned one under the other and adjusted to straight and bend portions of a tube being bent, said clamping faces of said bending template and clamping jaw being spaced from each other and bringable into an operation position relative to each other, two hydraulic drives each of which vertically moves the respective clamping element and has a cylinder and a movable piston with a piston rod, the improvement comprising that a respective cylinder of the hydraulic drive of at least one clamping element is arranged in the interior of and integrated within a body of at least the bending template or the clamping jaw, and a respective piston rod of the hydraulic drive of said at least one clamping element is connected with said at least one clamping element so that said at least one clamping element is moved by and moves with the respective piston rod.

2. The tube bending machine as defined in claim 1, said clamping jaw being rotatable about a horizontal axis and having two limiting flat surfaces positioned at right angles to each other, one of said flat surfaces supporting a respective clamping element displaceably by a respective hydraulic drive parallel to a respective cylinder, while the other of said flat surfaces stationarily supports an additional clamping element.

3. The tube bending machine as defined in claim 2, wherein the clamping element mounted in said bending template has three such clamping faces with different shapes and the clamping element mounted on said clamping jaw has two such clamping faces with different shapes.

4. The tube bending machine as defined in claim 1; and further comprising a boom which connects a respective piston rod of the hydraulic drive of the respective clamping element with the respective clamping element and extends outside of the bending template or the clamping jaw, respectively.

5. The tube bending machine as defined in claim 1, wherein a respective cylinder of the hydraulic drive of the other clamping element is arranged in the interior of and integrated within a body of the other of the bending template or the clamping jaw, a respective piston rod of the hydraulic drive of said other clamping element is connected with said other clamping element so that said other clamping element is moved by and moves with the respective piston rod.

6. In a tube bending machine comprising a bending table pivotable about a first vertical axis and including a bending template, a clamping jaw displaceable relative to the bending template for clamping a tube between the clamping jaw and bending template to bend said tube about said bending template, and a displaceable feeding carriage having a rotatable clamping sleeve for clamping a tube being bent and for feeding and rotating said tube through said clamping jaw and bending template, whereby the bending template and the clamping jaw have, respectively, clamping elements each having at least two clamping faces which have different shapes, are positioned one under the other and adjusted to straight and bend portions of a tube being bent, said clamping faces of said bending template and clamping jaw being spaced from each other and bringable into an operation position relative to each other, two hydraulic drives each of which vertically moves the respective clamping element and has a cylinder and a movable piston with a piston rod, the improvement comprising that a respective cylinder of the hydraulic drive of at least one clamping element is arranged in the interior of the integrated within a body of at least the bending template or the clamping jaw, and a respective piston rod of the hydraulic drive of said at least one clamping element is connected with said at least one clamping element so that said at least one clamping element is moved by and moves with the respective piston rod, and that a boom connects the respective piston rod of the hydraulic drive of said at least one clamping element with said at least one clamping element and extends outside of the bending template or the clamping jaw, respectively.

* * * * *